US007191557B2

(12) United States Patent
Gablowski et al.

(10) Patent No.: US 7,191,557 B2
(45) Date of Patent: Mar. 20, 2007

(54) FIREARMS, GRIPS FOR FIREARMS, AND METHODS FOR USING THE SAME

(75) Inventors: Jürgen Gablowski, Oberndorf (DE); Wolfgang Bantle, Oberndorf (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 11/224,341

(22) Filed: Sep. 12, 2005

(65) Prior Publication Data

US 2006/0064913 A1 Mar. 30, 2006

Related U.S. Application Data

(63) Continuation of application No. PCT/EP2004/002526, filed on Mar. 11, 2004.

(30) Foreign Application Priority Data

Mar. 12, 2003 (DE) ..... 103 10 802

(51) Int. Cl.
*F41A 17/00* (2006.01)

(52) U.S. Cl. ..... 42/72; 42/73; 89/1.42

(58) Field of Classification Search ..... 42/71, 42/72, 73, 71.01, 94; 89/1.42, 37.04; 248/429
See application file for complete search history.

(56) References Cited

U.S. PATENT DOCUMENTS 2,826,824 A * 3/1958 Campbell ..... 34/467
2,826,848 A 3/1958 Davies
2,867,932 A * 1/1959 Keightley ..... 42/79
3,994,072 A * 11/1976 Agnello, Jr. ..... 42/132
5,956,879 A * 9/1999 Zerega ..... 42/72
6,070,354 A * 6/2000 Burigana et al. ..... 42/71.01
6,487,807 B1 * 12/2002 Kopman et al. ..... 42/94
6,698,127 B2 * 3/2004 Weber ..... 42/71.02
6,901,691 B1 * 6/2005 Little ..... 42/118
2005/0188588 A1 * 9/2005 Keng ..... 42/72
2005/0241206 A1 * 11/2005 Teetzel et al. ..... 42/72

OTHER PUBLICATIONS

Translation of the International Preliminary Report on Patentability for PCT/EP2004/002526, Mar. 2, 2006, 6 pages.
International Search Report for PCT/EP2004/002526, 3 pages.

* cited by examiner

*Primary Examiner*—Michelle Clement
*Assistant Examiner*—Benjamin P. Lee
(74) *Attorney, Agent, or Firm*—Hanley, Flight & Zimmerman, LLC

(57) ABSTRACT

Firearms, grips for firearms and methods of using the same are disclosed. An example grip includes an exterior grip defining an inner bore; a slider located within the bore for axial movement relative to the exterior grip, the slider having a projection to selectively detachably engage the at least one transverse slot of the rail; and a screw rotatably mounted within the exterior grip. The screw threadingly engages the slider to axially move the slider into and/or out of engagement with the rail, but the screw is substantially secured against axial movement relative to the exterior grip.

19 Claims, 5 Drawing Sheets

FIREARMS, GRIPS FOR FIREARMS, AND METHODS FOR USING THE SAME

RELATED APPLICATION

This patent is a continuation of International Patent Application Ser. No. PCT/EP2004/002526, filed Mar. 11, 2004, which is hereby incorporated herein by reference in its entirety.

FIELD OF THE DISCLOSURE

This disclosure relates generally to firearms, and, more particularly, to firearms which are equipped with a longitudinal sectional rail with transverse slots (e.g., a "Picatinny rail"), grips for firearms and methods of using the same.

BACKGROUND

For many decades people have mounted accessories to weapons via structures such as dovetail sections or prismatic rails that are coupled to, or constructed on, the weapon. In such circumstances, a complementary base may be slipped over the rail and coupled thereto via mechanical fasteners such as screws. For example, this is a well-known construction used for so-called "slip-on assemblies" such as telescopic sights on low performance rifles. The base may also be clamped to the sectional rail via a lever. Use of such a lever is known, for instance, for more demanding and/or larger telescopic sight assemblies, for example, for military rifles such as the German G 43. The German 43 also comes standard with a dovetail section laterally on the breech box.

However, all of these attachments have one feature in common, namely, the fact that breaking points are quickly reached with stress fit or press fit connections. Only recently has the practice of mounting sectional rails with a considerable width on the front side of firearms gained acceptance (usually with rifles or submachine guns, but also in the context of semi-automatic pistols or even crossbows). These sectional rails usually exhibit transverse slots exposed to the outside for the attachment of many possible different accessories. These sectional rails are called "Picatinny rails" and usually consist of plastic or reinforced plastic. For this reason, Picatinny rails weigh as little as the much smaller dovetail rails, but are able to absorb considerably more force than dovetail rails. Consequently, Picatinny rails are suitable for mounting both relatively small telescopic sights and larger firing guide units or the like. The large dimensions of the rail and the complementary base reduce the occurring surface pressure. This is of particular advantage in the case of heavy accessories. Picatinny rails can be mounted on the top, on the sides, and/or on the bottom of a weapon. The connection between the Picatinny rail and the weapon is usually detachable.

A disadvantage that occurs particularly with rapid fire weapons is that the hand that grasps under the hand guard does not have sufficient grip to adequately and reliably control and aim the weapon. This problem is manifested in, for example, in submachine guns such as the German MP 38/40. While the MP 38/40 does include a ribbed hand guard, marksmen regularly grasp the magazine instead of the hand guard because they can hold and control the weapon better with this alternative grip. The alternative grip also enables the shooter to pull the weapon into the shoulder better.

Attempts have been made to improve the grasping and holding of a weapon with two hands by providing an additional handle or a similar folding construction. For example, the Romanian version of the Soviet Kalashnikov AK 47 rifle was modified to include a pistol grip on the wooden front stock. This pistol grip served as an additional handle to facilitate control of the weapon. In another example, an additional handle or similar folding construction was added to the Beretta rapid-firing pistol Mod. 93 R so that the pistol could be held with two hands. This two handed grip improved the grasp a marksmen could have on the weapon.

In another example, U.S. Pat. No. 6,487,807 ("the '807 patent") describes a grip with a tripod that can be slipped onto a rail on the front of the rifle. Further, the Internet publication XP-002284888 makes it clear that a grip mounted to a Picatinny rail was already known on the application date, and U.S. Pat. No. 2,826,848 describes a grip on the front stock of a front stock loader (pump action).

All of the figures show the same example grip. The reference symbols apply for all of the figures, but may, for clarity's sake, not be used in every figure.

DETAILED DESCRIPTION

Throughout this patent, position designations such as "above," "below," "top'" "forward," "rear," etc. are referenced to a firearm held in a normal firing position (i.e., pointed away from the shooter in a generally horizontal direction).

Figure 1:
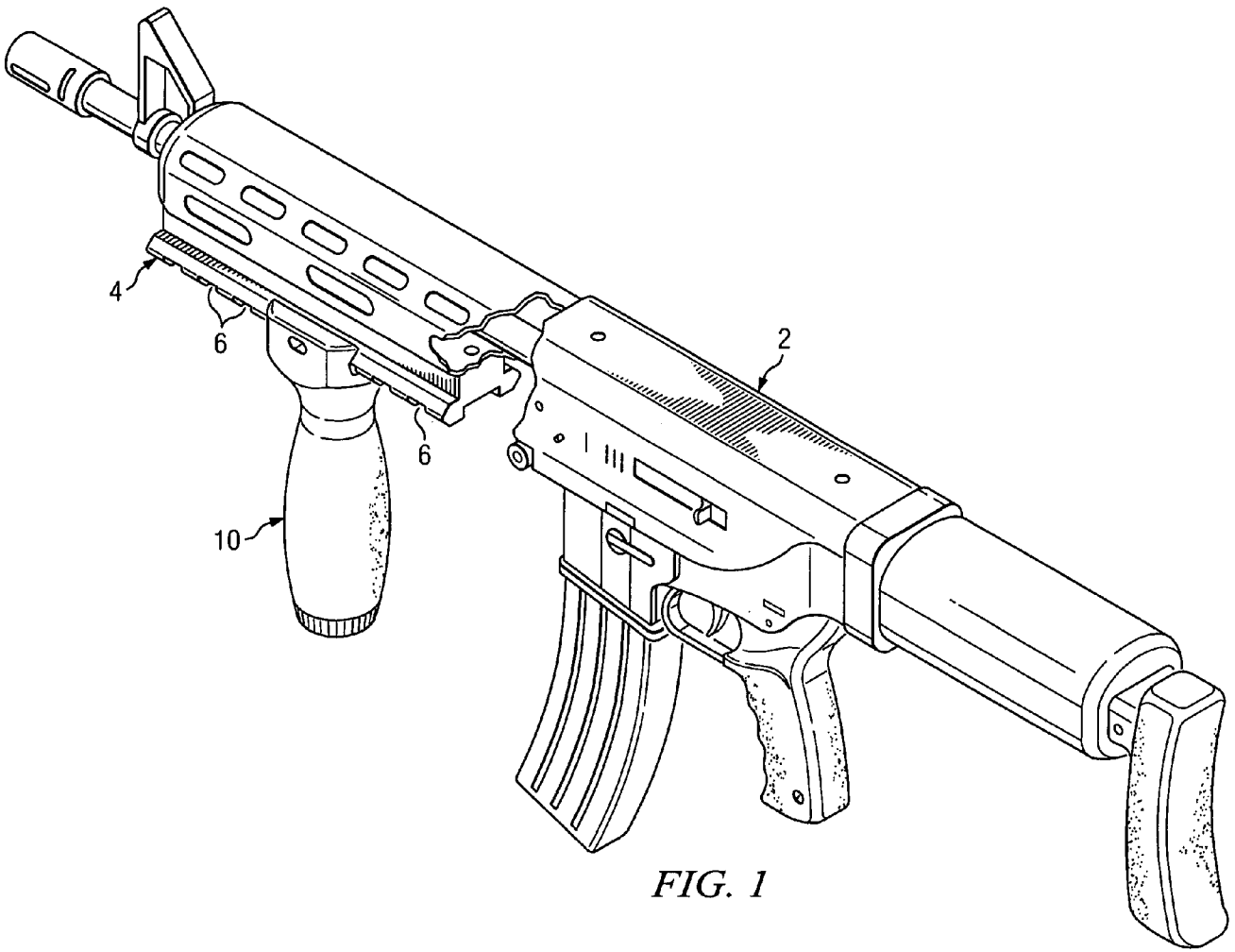
FIG. 1 is a perspective view of an example firearm partially broken away with an example rail and an example grip mounted on the underside of the firearm.
Figure 2:
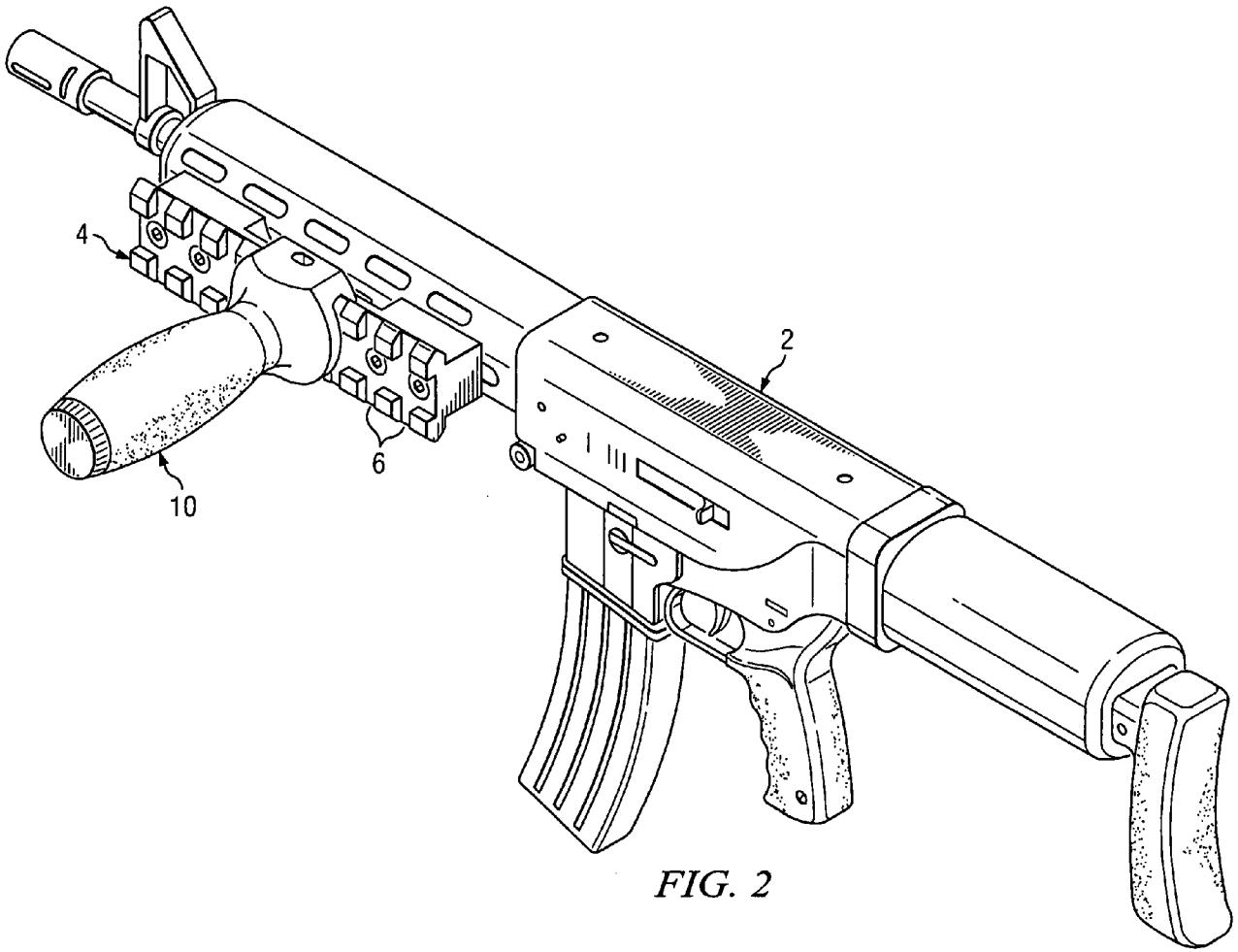
FIG. 2 is a perspective view of an example firearm with an example rail and example grip mounted on the side of the firearm.
Figure 3:
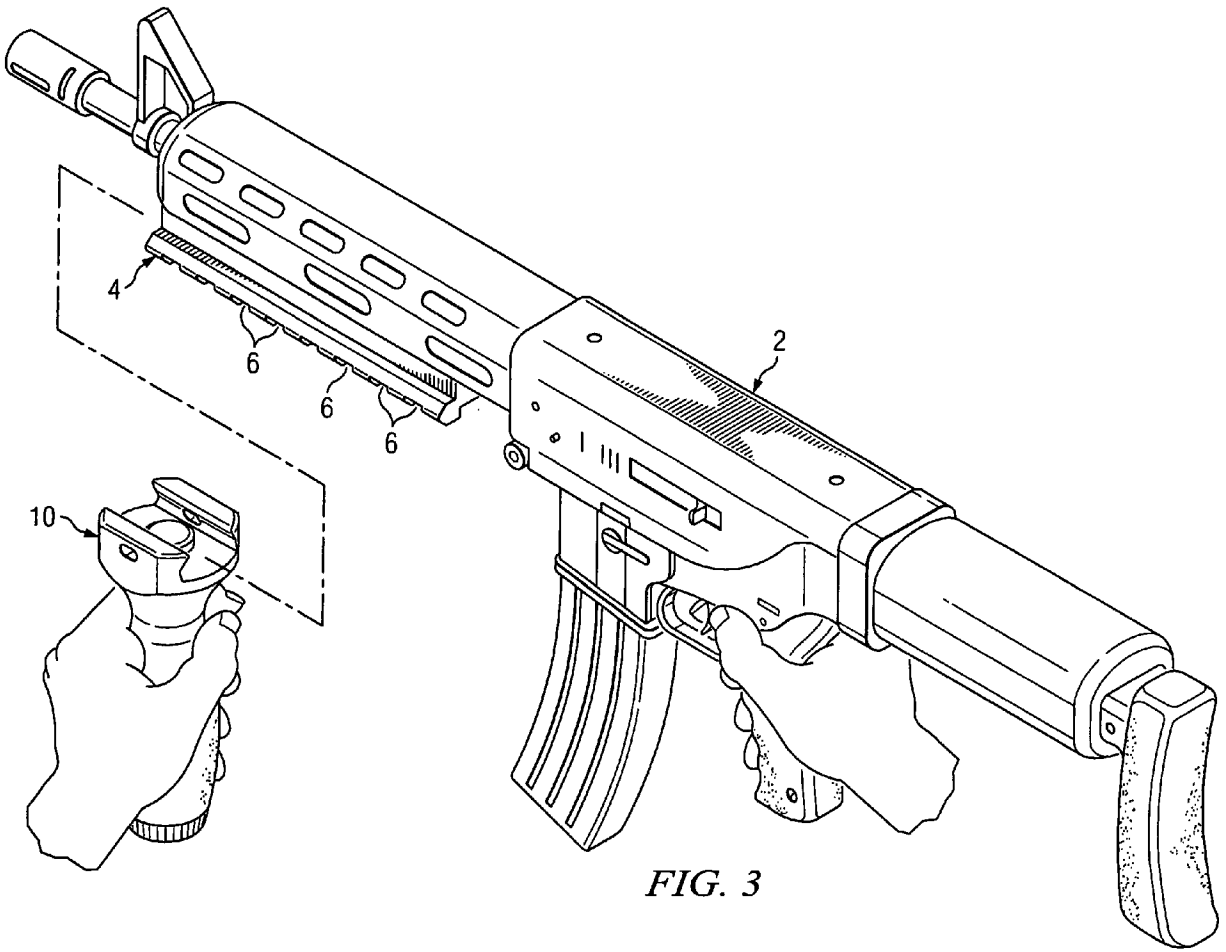
FIG. 3 is an exploded view of the firearm of FIG. 1.

FIGS. 1–3 is a side view of an example grip 10 that may be mounted to a sectional rail 4, such as a Picatinny or prismatic rail, which is mounted to the side or bottom of the front end of a firearm 2. When the example grip 10 depicted in FIGS. 1–3 is mounted on the weapon 2, the prismatic rail 4 runs from right to left in FIG. 1, and the grip 10 protrudes to the bottom or to the side of the weapon 2, depending on the location of the rail 4 on the weapon 2.

Figure 5:
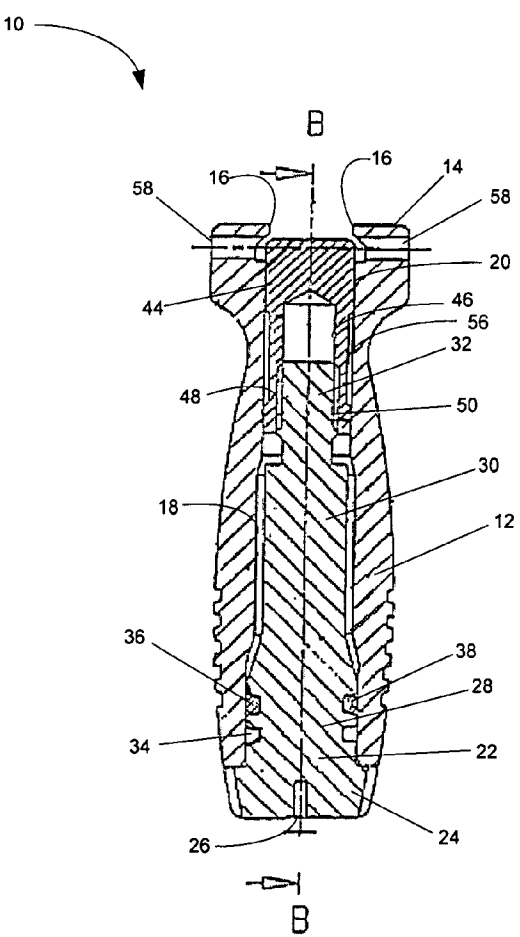
FIG. 5 is a cross-sectional view of the example grip of FIG. 4 taken along line A—A of FIG. 4.
Figure 4:
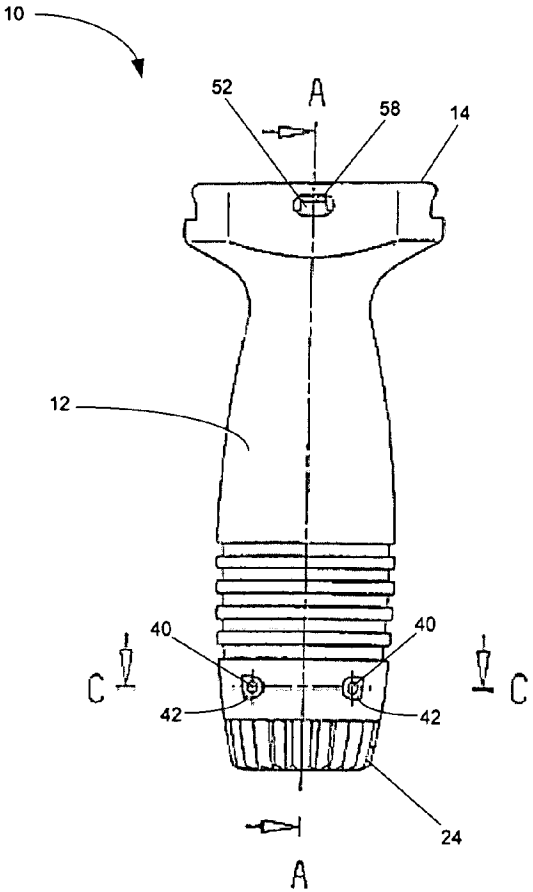
FIG. 4 is a side view of an example grip constructed in accordance with the teachings of the invention.
Figure 6:
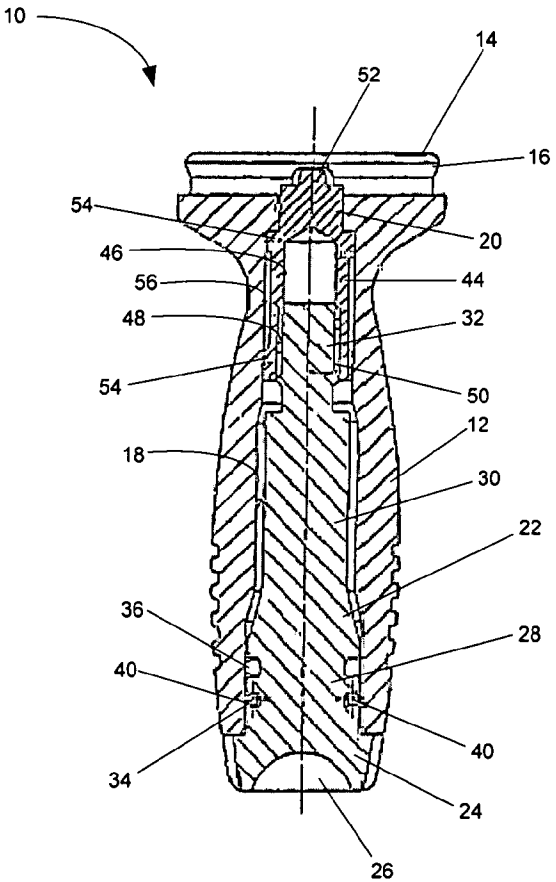
FIG. 6 is a cross-sectional view of the example grip of FIG. 4 taken along line B—B of FIG. 4.

The example grip 10 illustrated in FIGS. 1–7 includes an exterior grip portion 12, a screw 22 that rotatably mounted within the grip portion 12, and a slider 44 connected to the screw 22 in the manner of an actuator as explained in further detail below. The example exterior grip 10 may be formed from a single piece of plastic or reinforced plastic (similar to a tool handle such as a screwdriver handle). The example grip 10 also includes a construction 14 that is complementary to a prismatic rail. The construction 14, which is shown in greater detail in FIGS. 5 and 6, is molded onto the upper side of the grip 10 and may be coupled to a prismatic rail 4. To this end, the construction 14 includes two lateral engagement lips 16 (see FIG. 5) for lateral engagement with the prismatic rail 4. The engagement lips 16 may be slipped onto the prismatic or Picatinny rail 4 (for example, from the front of the rail toward the back). The lips 16 extend over a considerable distance. As a result, the engagement lips 16 of the illustrated example sit firmly on the prismatic rail 4 and are, thus, substantially free from wobbling.

The exterior grip portion 12 is penetrated by a center longitudinal bore 18, which has a round cross-section over the majority of its length. However, the upper section 20 of the center bore 18 near the construction 14 has a cross-section that is flattened on both sides and, hence, is out of round.

Figure 7:
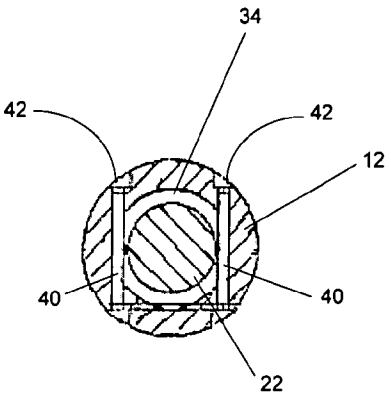
FIG. 7 is a cross-sectional view of the example grip of FIG. 4 taken along line C—C of FIG. 4.

In the example shown in FIGS. 5–7, the screw 22 is rotatably mounted within the central bore 18 of the exterior grip portion 12. More specifically, the illustrated example screw 22 is seated in the round section of the center bore 18. The screw 22 may be made of plastic, preferably has a round cross-section and also has a head 24. In order to facilitate easy turning of the screw 22, the head 24 of the screw 22 protrudes slightly from the bottom of the exterior grip portion 12 and has a roughly milled circumferential border. The head 24 also includes an end slot 26, in which a tool, such as for example, a coin, can be inserted and used to rotate the screw 22.

The example screw 22 shown in FIG. 5 has three cylindrical sections proceeding from the head 24. In particular, the screw 24 includes a first cylindrical section 28 with a large diameter, a following cylindrical compression section 30 having a smaller diameter than the first section, and finally, a cylindrical threaded end section 32 with a diameter that is smaller than the diameter of the head 24, the diameter of the first section 28 and the diameter of the compression section 30. The first section 28 defines two snap ring grooves, namely, a lower snap ring groove 34 and an upper snap ring groove 36. A rubber o-ring 38 is seated in the upper snap ring groove 36. The o-ring 38 rests in absorbing engagement with the inner surface of the complementary cylindrical center bore 18.

As most easily seen in FIG. 8, two tangential bolts 40 run through the lower snap ring groove 34 on opposite sides of the screw 22. The bolts 40 of the illustrated example are implemented as spring pins which are driven into bolt bores 42 defined in the exterior grip portion 12 from outside that exterior grip portion 12. The screw 22 is twistable within the center bore 18, but is axially stationary. The head 24 of the screw 22 is exposed.

The center compression section 30 of the screw 22 is spaced opposite the inner wall of the center bore 18. Consequently, when the screw 22 is tightened and the compression section 30 is compressed lengthwise, the compressed section 30 can expand slightly.

The threaded section 32 has a male thread 50 and is connected to the slider 44 in the manner of an actuator. To this end, the slider 44 defines a pocket bore 46 that has a female thread 48 which is structured to connect to the male thread 50 on the threaded section 32 of the screw 22. The thread pairing 48, 50 has a left-handed thread.

The slider 44 is pushed into the center bore 18 prior to the insertion of the screw 22. The slider 44 of the illustrated example comprises an aluminum alloy. The illustrated slider 44 has an out of round end section and a trapezoidal projection 52. The projection 52 projects upward and tapers off at its free end. The out of round portion of the slider 44 fits in the out of round, upper section 20 of the central bore 18 and is axially movable therein, but untwistable. A comparison of FIGS. 5 and 6 clearly shows the non-circular cross-sections of the slider 44 and the upper section 20 of the center bore 18.

The slider 44 also has two ring extensions 54. These extensions 54 are disposed in a middle cylindrical portion 56 of the center bore 18. The middle portion 56 of the central bore 18 lies between the out of round upper section 20 of the bore 18 and the cylindrical longitudinal bore section of the bore 18 which surrounds the cylindrical compression section 30 of the screw 22.

In the illustrated example, the exterior grip portion 12 defines a window 58 or opening through the construction 14. This window is oriented in a direction substantially perpendicular to the longitudinal axis of the prismatic rail 4. The window 58 enables the marksman to see the trapezoidal projection 52 of the slider 44 as it engages in a traverse slot of the prismatic rail. Therefore, a glance in the window 58 is sufficient to determine whether the grip 10 is securely engaged to the prismatic rail 4 (i.e., the narrow side of the trapezoidal projection 52 is visible) or not (i.e., the narrow side of the trapezoidal projection 52 is not visible). In a preferred example, there are two windows 58, as shown in FIG. 5.

An example manner of mounting the example grip 10 on a Picatinny rail 4 will now be described. First, the head 24 of the screw 22 is turned counter-clockwise, which causes the threads 48, 50 to tighten and the screw 22 to further engage or screw into the slider 44. Consequently, the slider is pulled into the exterior grip portion 12 until the top of the trapezoidal projection 52 is flush with the bottom of the complementary construction 14. Next, the construction 14 is slipped onto the prismatic rail 4 until the cross-section of one of the transverse slots 6 of the prismatic rail 4 can be detected in the window 58.

Next, the head 24 of the screw 22 is turned in the opposite direction (i.e., clockwise, when seen from below) until the trapezoidal projection 52 engages in a transverse slot 6 and the screw 22 becomes tight. During this tightening, the tapered shape of the trapezoidal projection 52 is particular useful because it facilitates a "threading" into the transverse slot 6 of the prismatic rail 4. A glance at one of the two windows 58 makes it possible for the marksman to see for himself if the grip 10 is seated on the prismatic rail 4—conforming to specifications.

Because the example screw 22 is made of plastic, the compression section 30 is subjected to a slight compression. However, the threaded connection 48, 50 secures and guarantees the permanent seat of the grip 10. Furthermore, the considerable length of the construction 14 prevents wobbling of the grip 10, and the rubber o-ring 38 prevents the screw 22 from jarring.

To remove the grip 10 from a rail 4, the screw 22 is loosened (i.e., the head 24 is turned counter-clockwise (again, seen from below), if necessary by using a coin which fits into the slot 26 in the head of the screw 22) and sliding the exterior grip portion 12 along and off of the prismatic rail 4.

From the forgoing, persons of ordinary skill in the art will readily appreciate that alternative ways of equipping a weapon 2 with an additional grip 10 on its front side have been disclosed. An illustrated example grip 10 is detachably mounted to a sectional rail 4 that is mounted to the weapon 2. The example grip 10 is not mounted directly to the weapon 2, but rather to a sectional rail 4 that is mounted to the weapon 2.

A person of ordinary skill in the art will further appreciate that the practice of embedding metal rails into the front stock of match rifles and mounting a rest for the left hand of the marksman that can be moved longitudinally has been well-known for a long time. However, this prior art construction is not a "grip" as disclosed by the illustrated example, such as for example the grip of a crank. Rather the prior art constructions are hand rests, sometimes even orthopedically shaped—hand rests, which, while serving the purpose of propping up the rifle, cannot be used to pull the rifle into the shoulder or even to prevent the weapon from drifting in the case of rapid fire.

In contrast, the example grip 10 described above serves the purpose of being firmly grasped in order to, for example, reliably hold the weapon 2 to fire from the hip or to powerfully pull the weapon 2 into the shoulder for sustained firing. Moreover, the grip 10 provides the hand with a stable support, which is especially useful when, for instance, a barrel of a semi-automatic weapon becomes hot after several rounds, and the danger that the marksman will injure his hand or at least irritate it if he comes into contact with the hot barrel or with the gas stream of a gas-loading rifle arises. Experience shows that marksmen have a tendency to grasp their weapons too far to the front when they are in a hurry and that, during sustained firing, marksmen search for a handle with which they can pull the weapon into their shoulder without having to grasp the hand guard too firmly. The example grip 10 provides a safe and convenient position for marksmen to grasp the weapon while avoiding potential dangers and mistakes.

Additionally, the example grip 10 is detachable, and does not fold-down. As a result, it does not wobble unnecessarily and can be constructed economically. Further, because the grip 10 is detachable, it is not mounted or taken along when it is not needed. Because military operations are frequently restricted to few units and situations which, as a rule are predictable, drill weapons may be equipped with the grip prior to the corresponding drill.

A further advantage of the example grip 10 is that, with longer sectional rails, the location of the grip in the longitudinal direction of the weapon can be selected in such a way that it corresponds to physical dimensions, tendencies, and/or habits of the marksman. Persons of ordinary skill in the art will appreciate that, before the development of the example grip 10, marksmen were expected to adapt to the shape and dimensions of the weapon. However, the example grip 10 enables marksmen to adapt the weapon to suit the marksman's dimensions and preferences. As a result, different marksmen can achieve optimum performance with the same government-issue weapon, even with little training. In particular marksmen with extreme physical dimensions, who up to now have always had difficulties with the dimensions of the weapon, can at least improve the position of the example grip 10 to suit their own situation.

Another advantage of the above described example is that considerable forces may be applied to the Picatinny sectional rail 4 via the grip 10 without causing any long-term damage to the weapon 2. It is also advantageous that the grip 10 may be detachably clamped to the rail 4 with a close fit, which allows for more liberal tolerances in the fitting between the sectional rail 4 and the construction 14 that is slipped on the sectional rail 4, without jeopardizing or compromising the firm fit of the grip 10 on the rail 4.

In alternative examples, the grip 10 could alternatively be fastened to the sectional rail without being specifically adapted to it. However, in such examples, special clamping devices and, possibly, additional constructions on the sectional rail are necessary for placement and removal of the grip 10 on the rail. In some such examples, the grip 10 has a construction complementary to the sectional rail, and the grip 10 is slipped on to the sectional rail over the construction and is detachably clamped to the construction. The grip 10 can then be mounted to, for example, a government-issue weapon, or to any other weapon, even if the grip 10 has not been provided for this purpose. Further, placement or removal of the grip 10 only requires the clamping or detachment of the clamping device. Furthermore, the clamping devices may be quite simple in construction.

An example device that may be used as the clamping device in this alternative embodiment is a set screw. However, a set screw requires a stable internal thread, and would press against the sectional rail, where it could result in deformations.

As mentioned above, a sectional rail 4, such as a Picatinny rail is mostly made of plastic or of fiber-reinforced plastic. In the illustrated example, a slider 44 longitudinally penetrates the grip 10. The slider 44 of the illustrated example is aligned with one of the transverse slots 6 of the rail 4, and presses detachably in a direction against the sectional rail 4. The pressure of the slider 44 against the sectional rail 4 does not occur on the outer surfaces of the rail 4, upon which the grip 10 is slipped, but rather in one of the transverse slots 6 of the rail 4, whose base may, if necessary, be deformed without jeopardizing the function of the sectional rail 4. Moreover, by suitably dimensioning the slider 44 (which can be the entire length of the transverse slot 6) to adapt to the shape of the transverse slot 6 base, the surface pressure on the sectional rail 4 can be reduced to the point that the sectional rail 4 remains undamaged under all circumstances. Further, the grip 10 always remains in its location. In other words, the grip 10 cannot accidentally slip from the sectional rail 4. This is true even if the clamping of the grip 10 should loosen, in which case the slight wobbling of the grip 10 would indicate to the marksman that the grip 10 has loosened and must be tightened.

In the illustrated example, the slider 44 is untwistably mounted in the exterior grip portion 12, but is able to be moved longitudinally. When the slider 44 is mounted within the exterior grip portion 12 in this manner, the slider 44 does not have to be twisted into its position first when the grip 10 is being placed on the rail because the slider 44 already occupies this position from the start. However, the fact that the slider 44 can only be moved longitudinally means that the grip 10 should also have a specified orientation, because the grip 10, like the slider 44, cannot twist when being attached to the rail 4.

There are three main parts to the example grip 10 discussed above, namely the exterior grip portion 12, the slider 44 and the screw 22. All three parts are not very complex and can, thus, be produced economically. To produce the example grip 10 as economically as possible, the twistable screw 22 is mounted in the exterior grip portion 12 and penetrates the free end of the handle. The screw 22 cannot be axially shifted, but this screw 22 can be screwed into the slider 44. Because the screw 22 cannot be axially shifted in the slider 44, the screw 22 is captive in the grip 10 (i.e., it will not separate from the grip). Screwing the screw 22 into the slider 44 tightens the threads 48, 50 to thereby pull the slider 44 into the exterior grip portion 12 and release the clamping with the sectional rail 4. On the other hand, unscrewing the screw 22 from the slider 44 pushes the slider 44 out of the exterior grip portion 12 and applies the necessary clamping power to secure the grip 10 to the rail 4.

The screw 22 is preferably connected to the slider 44 via a left-handed thread 48, 50. Thus, turning the screw 22 clockwise (when viewed from the bottom of the grip 10 adjacent the head 24) causes the slider 44 to move in a direction outward from the exterior grip portion 12, and vice versa. This configuration enables a marksman to fasten the grip 10 to the sectional rail 4 spontaneously and with little thought, because the marksman need only make the motion to screw the screw 22 directly into a firm thread on the rifle 2 as though the grip 10 is only penetrated by the screw 22, (i.e., the marksman need not consider the mechanical relationship between the screw 22 and the slider 44). Consequently, using the example grip 10 is significantly simplified In the illustrated example, the screw 22 is axially stationary within the exterior grip portion 12. Consequently, when the screw 22 is "tightened," the screw 22 actually remains in the same position relative to the exterior grip portion 12, but the slider 44 is moved axially away from the screw 22 (i.e., unscrewed from the screw 22) and projected toward the outside of the exterior grip portion 12. On the other hand, when the screw is to "unscrewed" to, for example, remove the grip 10 from the rail 4, the screw 22 is turned in a counter-clockwise direction (when viewed from the bottom of the grip 10 adjacent the head 24). This motion actually pulls the screw 22 and slider 44 together, thus, pulling the slider 44 into the exterior grip portion 12 and releasing the connection to the rail 4.

A set screw would suffice for axial fastening the screw 22. Such a set screw would penetrate the exterior grip portion 12 and engage a shoulder of the screw 22 to prevent it from moving axially. However, the present example utilizes a snap ring groove 34 within the exterior grip portion 12 to secure the screw 22 against axial movement. To this end, the illustrated example exterior grip portion 12 is penetrated on both sides of the screw 22 by tangential bolts 40, which tangentially abut the base of the snap ring groove 34. This design is both simple and stable. The tangential arrangement of the bolts 40 prevents any grooves from hindering the turning of the screw 22. The arrangement of two opposing bolts 40 ensures a strictly symmetrical load of screw 22 and grip 10. Persons of ordinary skill in the art will readily appreciate that the bolts 40 may be any mechanical fastener such as, for example, spring bolts, grooved pins, rivets, etc. The snap ring groove 34 can be produced particularly easily and cheaply. The loosening of the screw 22 from the exterior grip portion 12 is possible at any time by removing the bolts 40, but can be impeded by the selected type of bolt so that the average marksman will refrain from removing the screw 22.

Even if the slider 44 is partially embedded into the transverse slot 6 of the rail 4, the screw 22 may still be somewhat moveable along the rail 4, but such movement will produce a clatter sound. However, particularly in the case of government issue weapons, this should be prevented. To this end, a second snap ring groove is provided. A protruding washer 38 is inserted into the second snap ring groove. This washer 38 rests absorbingly against the central bore 10 of the exterior grip portion 12. The washer 38, which is preferably an o-ring, simultaneously prevents the penetration of dirt or water into the grip 10 from its free end. Moreover, the washer 38 gives the marksman the accurate feeling of having a component of the highest quality, which is absolutely reliable.

The example grip 10 could be made of metal. However, the grip 10 preferably comprises deformation resistant, rigid plastic. For example, the grip 10 could be made of the same plastic as the sectional rail 4. In this approach, the weight of the weapon is not unnecessarily increased by the grip 10. Preferably, the screw is also constructed of a deformation resistant, rigid plastic, for example the same plastic as is used to form the grip 10 and/or the rail 4. The slider 44 could also be made of plastic. However, preferably it is made of metal, most preferably, a light metal. Constructing the slider 44 in this manner ensures there is no danger that the slider 44 will deform or that dirt accumulation will cause the threading of the screw 22 to get stuck in the slider 44.

Because the example slider 44 is made of metal, it could simply have a bolt attachment with small diameter and outer threading. However, in the illustrated example, the slider 44 has an inner threading 48 and ring extensions 54. Placement of the ring extensions 54 in the center bore 18 of the exterior grip portion 12 guides the slider 44 in the exterior grip portion 12 and enables the slider 44 to have a good and accurate fit in the exterior portion of the grip 12 even though the slider 44, for weight reasons, may be relatively short.

In a preferred example, the slider 44 has a metallic color or an attractive chromatic color as a result of an anodization. The exterior grip portion 12, on the other hand, should be a black plastic, or plastic dyed in camouflage colors.

The illustrated example grip 10 includes a window 58. The window 58 is in the exterior grip portion 12 at about the height of the slider 44 when the slider 44 is extended into a position to be coupled to a transverse slot 6 of the sectional rail 4. Preferably, there are two windows 58 that are laterally arranged at this height on the exterior grip portion 12. The windows enable a marksman to quickly glance and recognize whether and how far the slider 44 is engaged in the transverse slot 6 of the rail 4. This is particularly beneficial, for example, if the screw 22 sticks due to dirt, and the marksman assumes that he has attached the grip 10 properly. A simple glance through a window 58 will quickly indicate to the marksman that the grip 10 is not properly secured onto the rail 4. In this way, the operational security of the grip 10 is even further increased.

Since the weapon and/or the sectional rail 4 must fit together with the grip 10, even if there is a certain standardization of the dimensions of the rail 4, the grip 10 will almost always be combined with a rail 4. However, the grip 10 can also be sold by itself Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. In combination, a firearm having a longitudinal sectional rail with transverse slots;

a grip structured to slip onto and detachably clamp to the rail, the grip including:

an exterior grip defining an inner bore having a length;

a slider penetrating at least a portion of the length of the bore, the slider having a projection to selectively detachably engage at least one of the transverse slots of the rail, the slider being axially movable relative to a longitudinal axis of the exterior grip, but being substantially secured against rotation within the exterior grip;

at least one window defined in the exterior grip at a location to view engagement of the projection of the slider with the at least one slot of the rail.

2. A combination as defined in claim 1, further comprising a screw rotatably mounted within the exterior grip, wherein the screw threadingly engages the slider and is substantially secured against axial movement relative to the exterior grip.

3. A combination as defined in claim 2, wherein the screw is connected to the slider by a left-handed thread.

4. A combination as defined in claim 2, further comprising:

a snap ring groove defined in the screw; and a bolt located in the snap ring groove and tangentially abutting an inner surface of the exterior grip.

5. A combination as defined in claim 2, wherein the screw defines a snap ring groove, and further comprising a washer located in the groove, the washer resting absorbingly against an inner surface of the exterior grip.

6. A combination as defined in claim 1, wherein the exterior grip comprises deformation resistant, rigid plastic.

7. A combination as defined in claim 2, wherein the screw comprises deformation resistant, rigid plastic.

8. A combination as defined in claim 1, wherein the slider comprises metal.

9. A combination as defined in claim 8, wherein the slider includes an outer ring land to guide the slider within the exterior grip.

10. For use with a firearm including a rail with at least one transverse slot, a grip comprising:

an exterior grip defining an inner bore;

a slider located within the bore for axially movement relative to a longitudinal axis of the exterior grip, the slider having a projection to selectively detachably engage the at least one transverse slot of the rail; and at least one window defined in the exterior grip at a location to view engagement of the projection of the slider with the at least one slot of the rail.

11. A grip as defined in claim 10, further comprising a screw rotatably mounted within the exterior grip, wherein the screw threadingly engages the slider and is substantially secured against axial movement relative to the exterior grip.

12. A grip as defined in claim 11, wherein the screw is connected to the slider by a left-handed thread.

13. A grip as defined in claim 11, further comprising:

a snap ring groove defined in the screw; and a bolt located in the snap ring groove and tangentially abutting an inner surface of the exterior grip.

14. A grip as defined in claim 11, wherein the screw defines a snap ring groove, and further comprising a washer located in the groove, the washer resting absorbingly against an inner surface of the exterior grip.

15. A grip as defined in claim 10, wherein the exterior grip comprises deformation resistant, rigid plastic.

16. A grip as defined in claim 11, wherein the screw comprises deformation resistant, rigid plastic.

17. A grip as defined in claim 10, wherein the slider comprises metal.

18. A grip as defined in claim 17, wherein the slider includes an outer ring land to guide the slider within the exterior grip.

19. A method for securing a grip to a rail associated with a firearm, the method comprising:

sliding the grip along the rail to a desired location;

rotating a screw that is located in the bottom of the grip to thereby cause a slider that is located at the opposite end of the grip to move along a longitudinal axis of the grip and away from the screw and into engagement with the rail, wherein rotating the screw does not move the screw longitudinally relative to the grip.

* * * * *